US011267616B1

(12) United States Patent
McGinnis

(10) Patent No.: US 11,267,616 B1
(45) Date of Patent: Mar. 8, 2022

(54) INSULATED BEVERAGE HOLDER WITH HANDLE

(71) Applicant: Hemetic Trading Co. LLC, Burlington, VT (US)

(72) Inventor: Matthew McGinnis, Burlington, VT (US)

(73) Assignee: Hemetic Trading Co. LLC, Burlington, VT (US)

( * ) Notice: Subject to any disclaimer, the term of this patent is extended or adjusted under 35 U.S.C. 154(b) by 57 days.

(21) Appl. No.: 16/948,326

(22) Filed: Sep. 14, 2020

Related U.S. Application Data

(63) Continuation-in-part of application No. 29/704,965, filed on Sep. 9, 2019, now Pat. No. Des. 929,193.

(60) Provisional application No. 62/899,791, filed on Sep. 13, 2019.

(51) Int. Cl.
*B65D 81/38* (2006.01)
*B65D 25/28* (2006.01)

(52) U.S. Cl.
CPC ..... *B65D 25/2811* (2013.01); *B65D 81/3876* (2013.01)

(58) Field of Classification Search
CPC ..... B65D 25/2811; B65D 81/3876; B65D 81/3886; F25D 2331/805; F25D 2331/8051; F25D 2303/0822; F25D 3/08; F25D 3/06
USPC ..... 220/739, 592.24, 592.16; 224/148.3
See application file for complete search history.

(56) References Cited

U.S. PATENT DOCUMENTS

| | | | | |
|---|---|---|---|---|
| 4,540,611 | A * | 9/1985 | Henderson | B65D 23/08 150/901 |
| 4,802,602 | A | 2/1989 | Evans et al. | |
| 5,048,734 | A | 9/1991 | Long | |
| 6,029,847 | A | 2/2000 | Mahoney, Jr. et al. | |
| 2004/0232156 | A1 * | 11/2004 | Hogan | B65D 25/2814 220/737 |
| 2012/0024875 | A1 * | 2/2012 | Zerda | B65D 81/3886 220/739 |
| 2013/0334073 | A1 | 12/2013 | Frye | |

OTHER PUBLICATIONS

Bic Graphic, "Koozie® Handle Strap Can Kooler", https://www.bicgraphic.com/cs/bg/product/46098C?ctrcd=US, accessed Oct. 3, 2019.

* cited by examiner

*Primary Examiner* — King M Chu
(74) *Attorney, Agent, or Firm* — Shawn Gordon, Esq.; Dunkiel Saunders Elliott Raubvogel & Hand, PLLC

(57) ABSTRACT

An insulating holder for beverage containers is provided that can be manufactured inexpensively. The holder includes a main panel formed from a rectangular sheet of a flexible material and a handle formed from a rectangular sheet of a flexible material. A length of the rectangular sheet of the handle is longer than a width of the rectangular sheet of the main panel. A first binding with a length equal to a length of the rectangular sheet of the main panel and a second binding with a length equal to a length of the rectangular sheet of the main panel are attached along the long edges of the main panel. The handle is formed by attaching the top edge of the handle to the top edge of the main panel and the bottom edge of the handle to the bottom edge of the main panel.

2 Claims, 10 Drawing Sheets

INSULATED BEVERAGE HOLDER WITH HANDLE

FIELD OF THE INVENTION

The present invention generally relates to insulated beverage holders. In particular, the present invention is directed to an Insulated Beverage Holder with Handle.

BACKGROUND

There are a variety of insulating holders that fit around beverage containers that reduce heat transfer to and from the beverage container. These beverage insulating holders slow the rate at which the temperature of a cold or hot beverage will rise or lower toward the ambient air temperature, which keeps the beverage closer to a desired consuming temperature and also can protect a user's hands from getting too hot or cold. Such insulating holders can further serve the purpose of making otherwise identical looking containers visually distinguishable from each other.

Beverage insulating holders can be a collapsible or self-supporting cylindrical structure that friction fits around the circumference of a beverage container. They may be bottomless or have a bottom surface, and may be openable with cooperative fastening means on opposing ends of the material that makes up the cylindrical surface.

In addition, some beverage insulating holders include a handle on a side for easier gripping, and may include logos, designs, and/or user identifying information on the surfaces of the holders.

SUMMARY OF THE DISCLOSURE

A method of making an insulated beverage holder is provided that includes forming a rectangular main panel made of flexible material, the main panel having a width, a top long edge, a bottom long edge, a first short edge, and a second short edge, wherein the first short edge and the second short edge have a length equal to the width and forming a rectangular handle portion made of flexible material, wherein the handle portion has a length that is greater than the width of the main panel and wherein the handle portion has a top edge along a handle width and a bottom edge along the handle width. The handle portion is attached to the main panel such that the bottom edge of the handle portion is aligned with a portion of the bottom long edge of the main panel. A first binding is attached along the top long edge of the main panel and a second binding is attached along the bottom long edge of the main panel, wherein the top edge of the handle portion is attached to the main panel by the attachment of the first binding such that the top edge of the handle portion is aligned with the top long edge of the main panel. The main panel is folded in half such that the first short edge is aligned with the second short edge and the handle portion is sandwiched within the main panel and then the first short edge is attached to the second short edge. The main panel is then inverted such that the handle portion faces outward.

An insulating holder for beverage containers is provided that includes a cylindrical main panel, the main panel being formed from a rectangular sheet of a flexible material and having a height, a top edge and a bottom edge, wherein the top edge and the bottom edge have a length. A handle is attached to the main panel, the handle being formed from a rectangular sheet of a flexible material and having a top short edge and a bottom short edge, wherein a length of the handle is longer than the height of the main panel. A first binding has a first binding length equal to the length of the top edge of the main panel and a second binding has a second binding length equal to the length of the bottom edge of the main panel. The first binding is sewn to the main panel along the top edge of the main panel, wherein the second binding is sewn to the main panel along the bottom edge of the main panel along the length of the main panel, wherein the top short edge of the handle is attached to and aligned with a portion of the top edge of the main panel, and wherein the bottom edge of the handle is attached to and aligned with a portion of the bottom edge of the main panel.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DESCRIPTION OF THE DISCLOSURE

Figure 1:
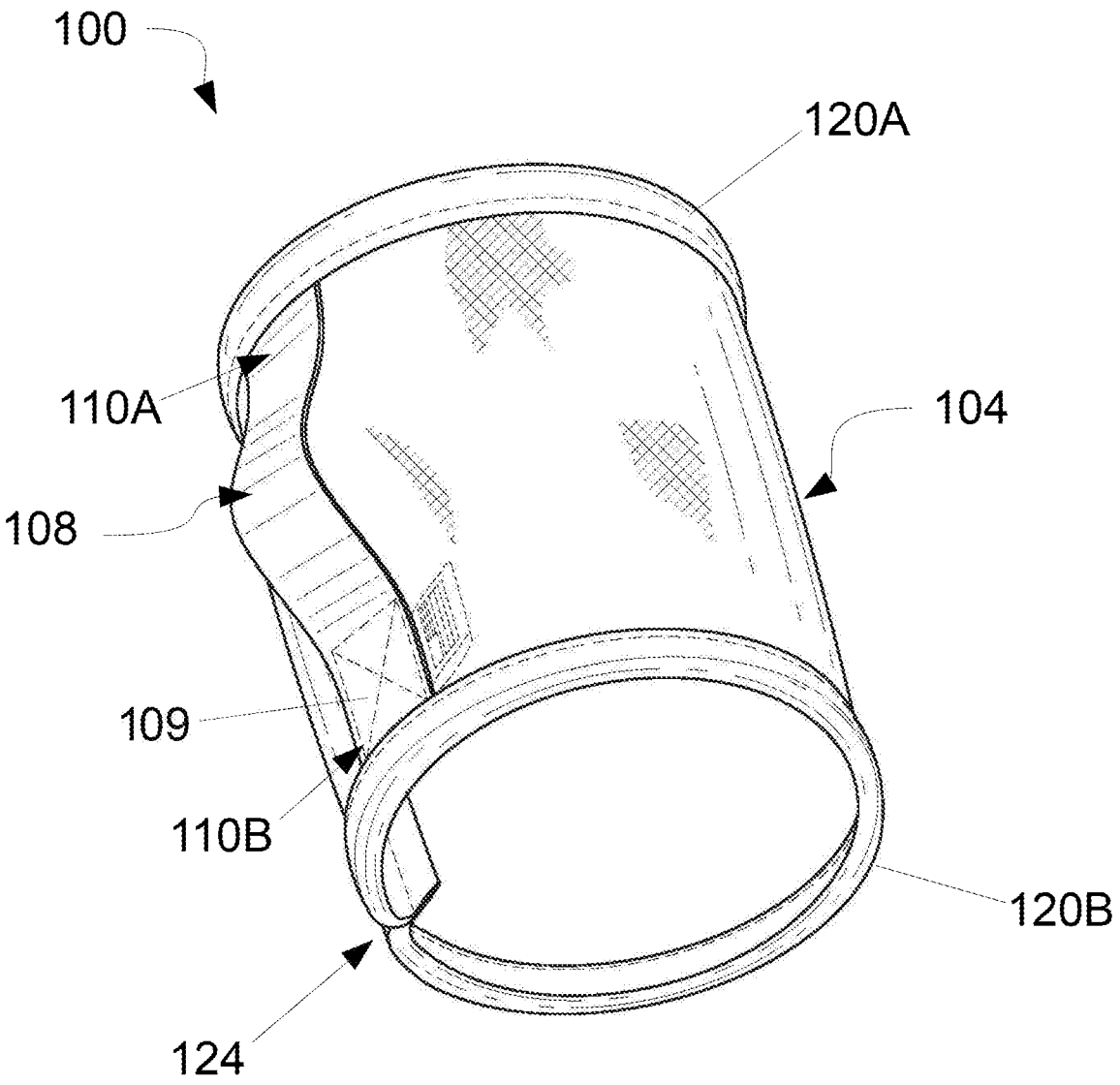
FIG. 1 is a perspective view of an insulated beverage holder in accordance with an embodiment of the present invention.
Figure 2:
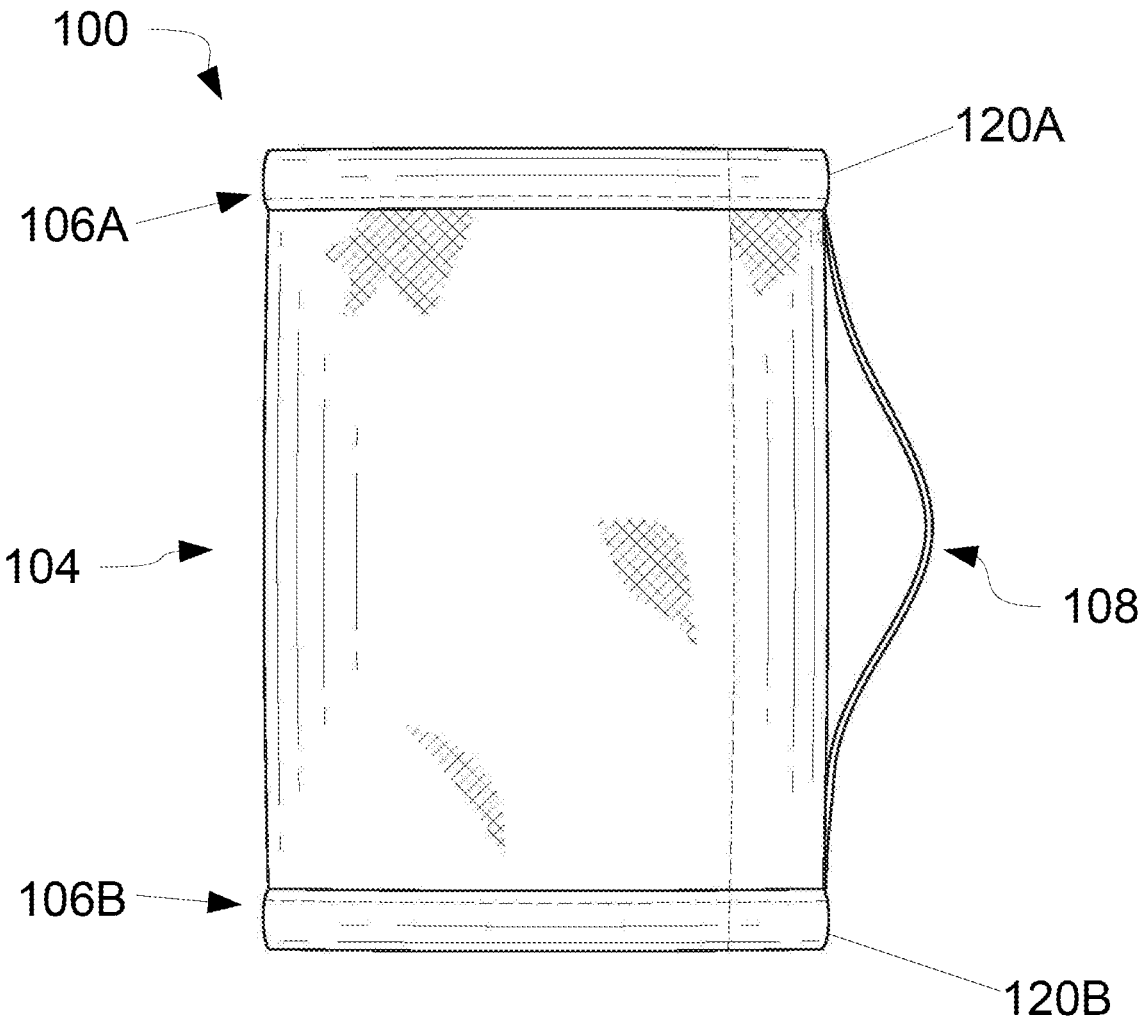
FIG. 2 is a side view of the beverage holder of FIG. 1.
Figure 3:
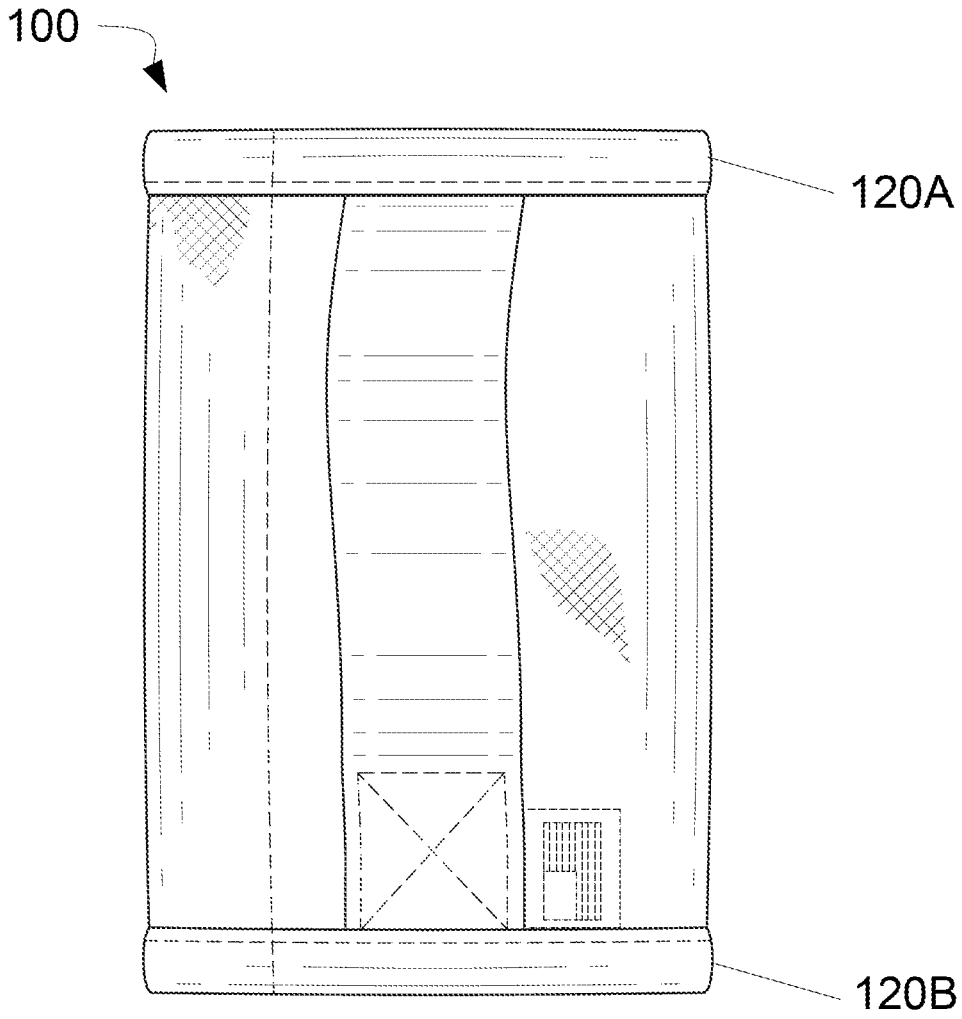
FIG. 3 is a rear view of the beverage holder of FIG. 1.
Figure 4:
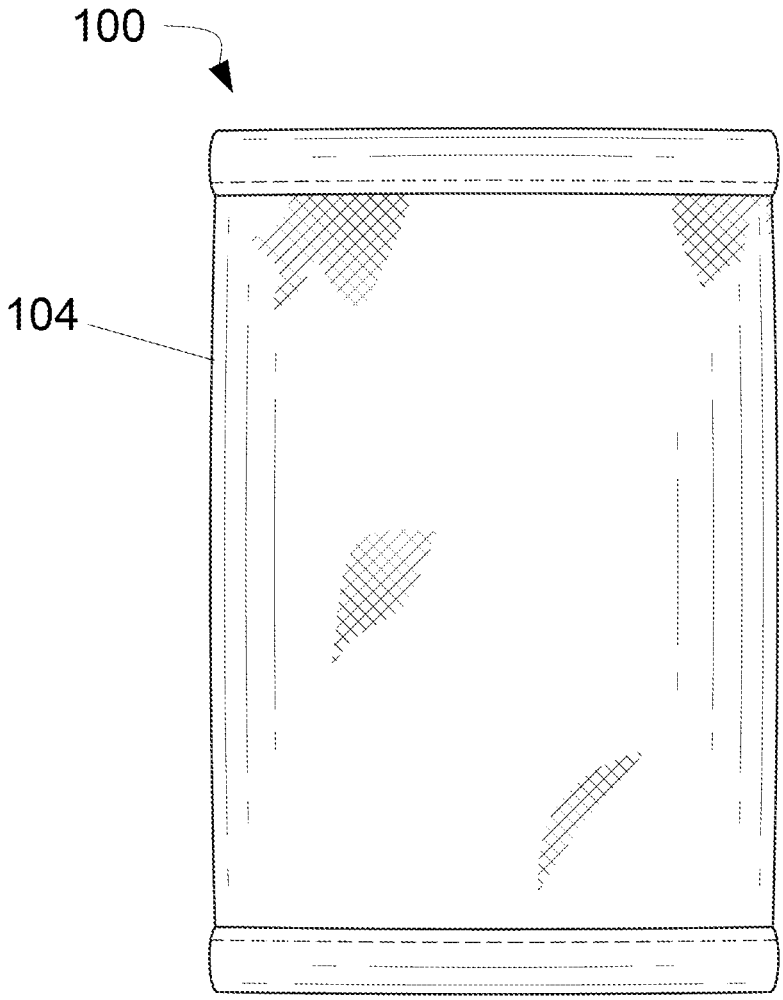
FIG. 4 is a front view of the beverage holder of FIG. 1.
Figure 5:
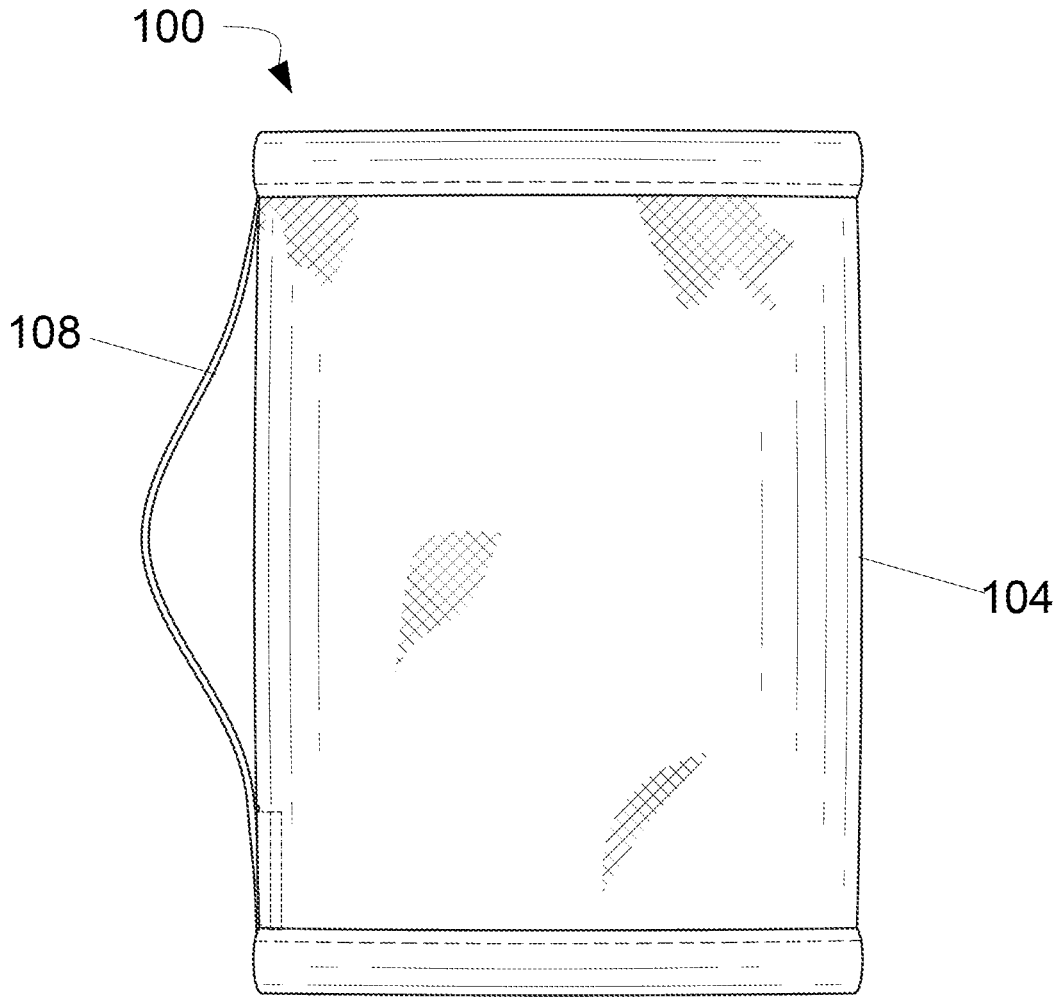
FIG. 5 is another side view of the beverage holder of FIG. 1.
Figure 6:
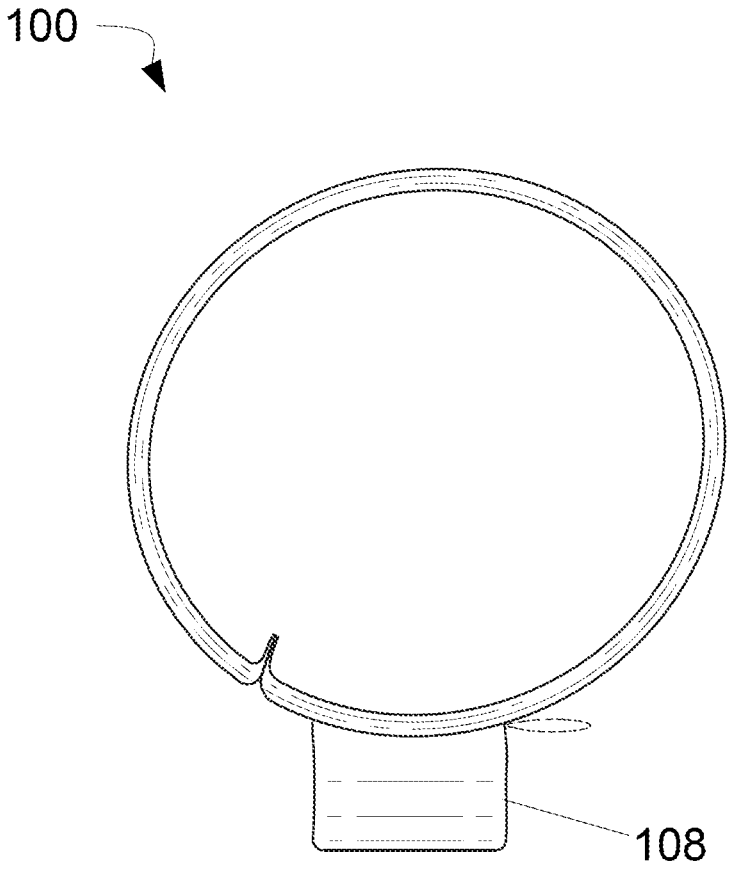
FIG. 6 is a bottom view of the beverage holder of FIG. 1.
Figure 7:
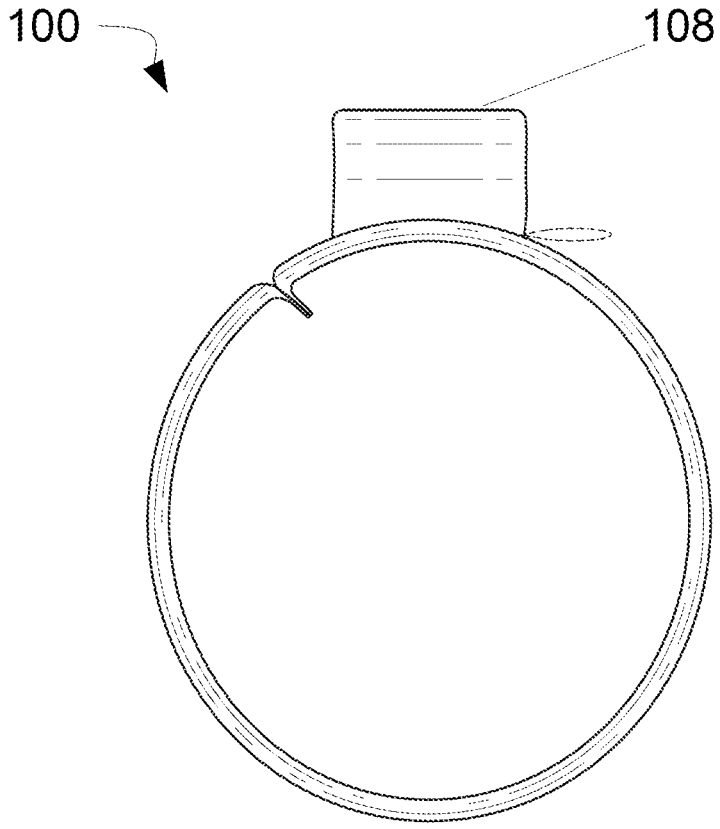
FIG. 7 is a top view of the beverage holder of FIG. 1.

An insulated beverage holder of the present invention includes a handle, has an open bottom, fits over a variety of beverage containers, and can be quickly and inexpensively constructed from a few components. In an embodiment, the beverage holder can be made from four components that are attached to each other in a manner that allows for the efficient formation of a holder.

Turning to the figures, an insulated beverage holder of the present invention, such as beverage holder 100 as shown in FIGS. 1-7, is generally flexible/stretchable and is designed to fit around a beverage container to insulate the container from its surroundings and the user's hand from the container. Holder 100 may be collapsible and may include personalized information or other information, such as logos, on its surface. Holder 100 includes a main panel 104 having a top edge 106A and a bottom edge 106B running along the long dimension, a handle piece 108 having a handle top edge 110A and a handle bottom edge 110B running along the short dimension, a top binding 120A, and a bottom binding 120B. In some embodiments, a portion of handle 108 extending upward from bottom edge 106A may be sewn to main panel 104 to form an attached segment 109 of handle 108.

In a preferred embodiment, handle piece 108 is longer than main panel 104 is widthwise such that when handle bottom edge 110B and handle top edge 110A are aligned with respective bottom edge 106B and top edge 106A of main panel 104, the extra length of handle piece 108 will allow it to bow out sufficiently to form a handle for holder 100. Top binding 120A and bottom binding 120B are attached to respective top edge 106A and bottom edge 106B of main panel 104.

Figure 8:
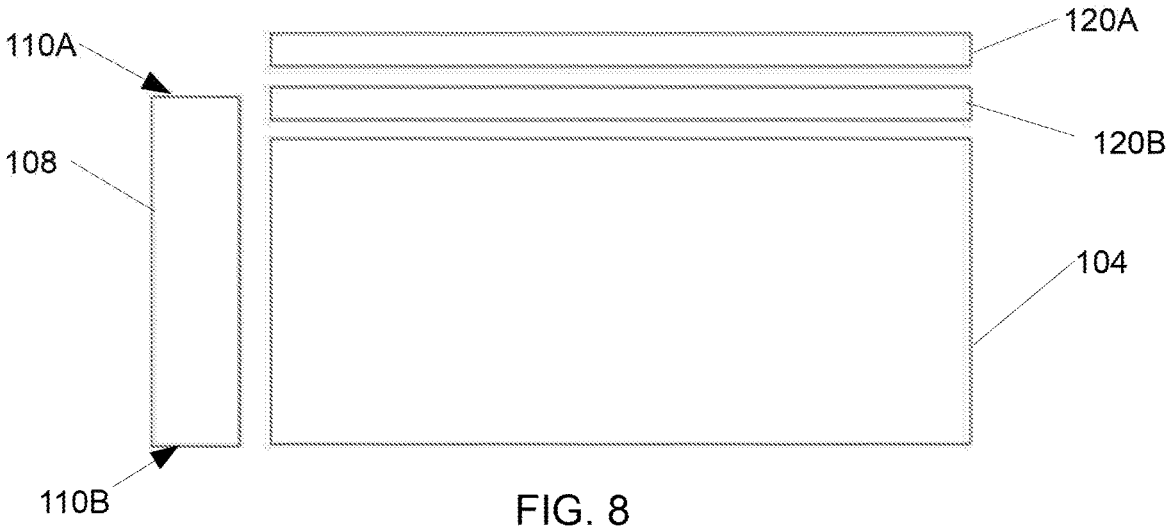
FIG. 8 shows the unassembled components of an insulated beverage holder in accordance with an embodiment of the present invention.

Beverage holder 100 may be assembled efficiently from these components. As shown in FIG. 8, the unassembled components are main panel 104, which may be a rectangular piece of flexible fabric; handle piece 108, which may be a rectangular piece of flexible fabric; and two bindings 120 (i.e., 102A, 120B). Each component may be made of any suitable material. Main panel 104 preferably is flexible/stretchable and has insulating properties, and handle piece 108 is preferably suitable for gripping. Handle piece 108 is longer than main panel 104 is wide (i.e., has a length that is greater than the height that holder 100 will have) by an amount sufficient to allow a handle structure to be formed when the components are assembled as described below. Bindings 120 are preferably approximately the same length as the long dimension of main panel 104 (i.e., have a length about the same as the circumference of holder 100 will have).

Figure 9:
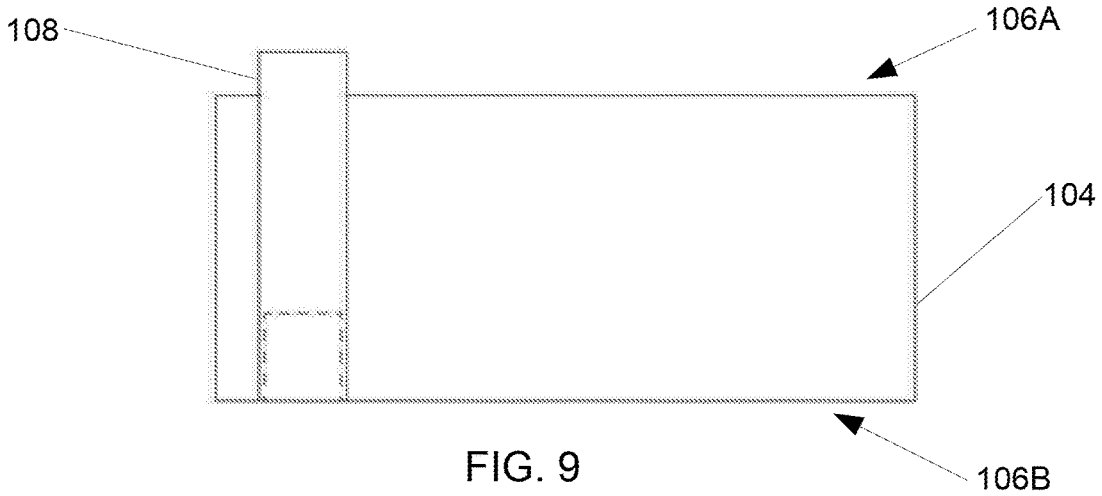
FIG. 9 shows some of the components of FIG. 8 partially assembled.
Figure 10:
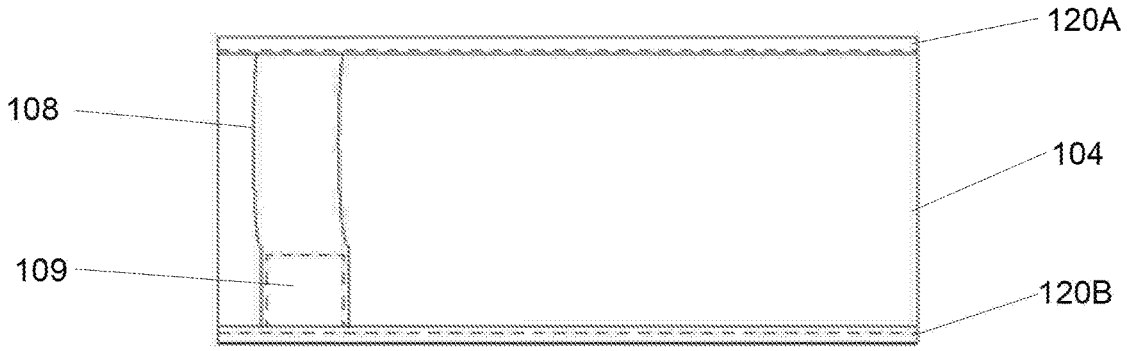
FIG. 10 shows some of the components of FIG. 8 partially assembled.
Figure 11:
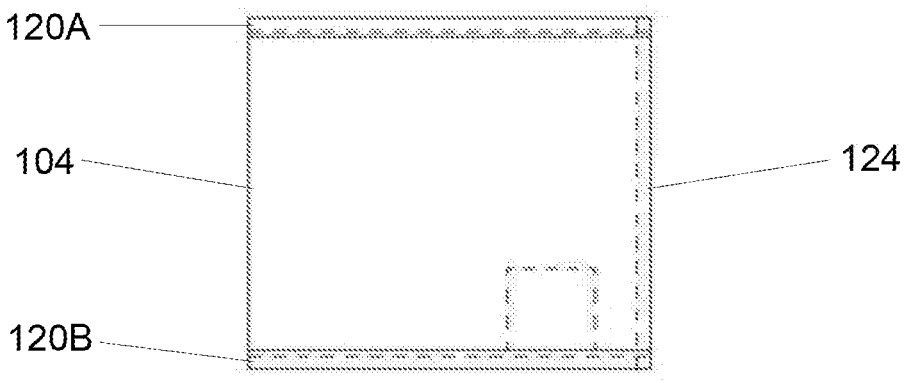
FIG. 11 shows some of the components of FIG. 8 partially assembled.
Figure 12:
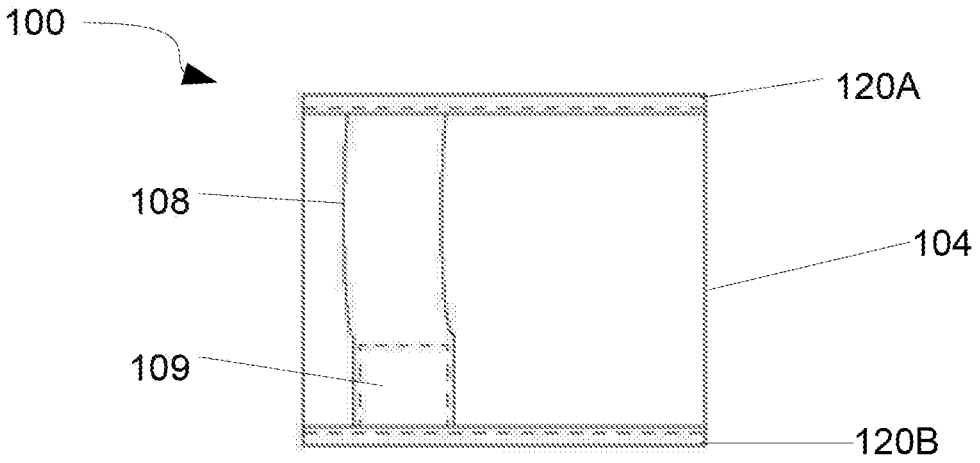
FIG. 12 shows the components of FIG. 8 assembled into an insulated beverage holder in accordance with an embodiment of the present invention.

In a first step of assembly, as shown in FIG. 9, handle piece 108 is sewn or otherwise suitably affixed to main panel 104 by aligning handle bottom edge 110B with bottom edge 106B. In the next step, as shown in FIG. 10, bottom binding 120B is affixed to bottom edge 106B and top binding 120A is affixed to top edge 106A. When top binding 120A is affixed to top edge 106A, handle top edge 110A is placed under top binding 120A and affixed to top edge 106A such that handle top edge 110A is aligned with top edge 106A. In this way, handle piece 108 forms a handle due to its length being greater than the height of main panel 104. In the next step, as shown in FIG. 11, main panel 104 is folded such that the short ends are aligned and handle piece 108 and attached bindings 120 are sandwiched within main panel 104. The short ends of main panel 104 are sewn or otherwise suitably attached to each other forming seam 124. Assembled holder 100 is then inverted so that handle piece 108 is on the outside as shown in FIG. 12.

Figure 13:
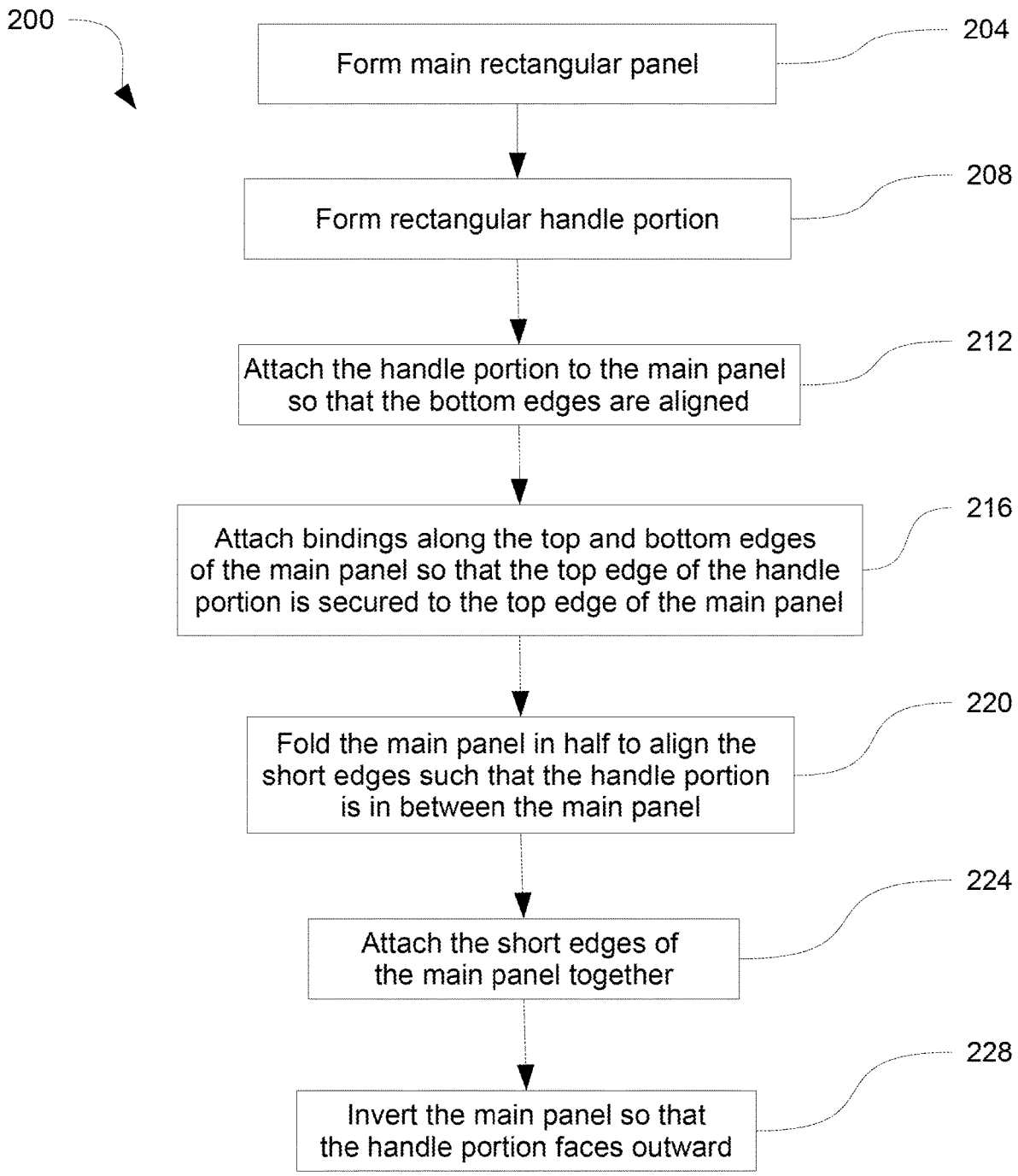
FIG. 13 is a process diagram for forming an insulated beverage holder in accordance with an embodiment of the present invention.

Turning to FIG. 13, an assembly method 200 is shown that includes forming a main rectangular panel at step 204 and forming a rectangular handle portion at step 208. At step 212 the handle portion is attached to the main panel along the bottom edge of the main panel so that the bottom short edge of the handle portion and a portion of the bottom long edge of the main panel are aligned. Once that attachment is made, the bindings are attached to the long edges of the main panel at step 216, in which the top short edge of the handle portion is incorporated into the attachment seem of the top binding to the top long edge of the main panel forming a handle. The main panel is folded in half at step 220 so that the two short edges meet and the attached handle is on the inside, i.e., between the fabric of the main panel. In that configuration, the short edges of the main panel are sewn together at step 224 to form a tube or cylinder shape. This is inverted at step 228 so that the handle now faces outward to form an insulated beverage holder with a handle.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A method of making an insulated beverage holder, comprising:

forming a rectangular main panel made of flexible material, the main panel having a width, a top long edge, a bottom long edge, a first short edge, and a second short edge, wherein the first short edge and the second short edge have a length equal to the width of the main panel;

forming a rectangular handle portion made of flexible material, wherein the handle portion has a handle portion length that is greater than the width of the main panel and wherein the handle portion has a top edge along a handle width and a bottom edge along the handle width;

attaching the handle portion to the main panel such that the bottom edge of the handle portion is aligned with a portion of the bottom long edge of the main panel;

attaching a first binding along the top long edge of the main panel and a second binding along the bottom long edge of the main panel, wherein the top edge of the handle portion is attached to the main panel by the attachment of the first binding such that the top edge of the handle portion is aligned with the top long edge of the main panel;

folding the main panel in half such the first short edge is aligned with the second short edge and the handle portion is sandwiched within the main panel;

attaching the first short edge to the second short edge; and inverting the main panel such that the handle portion faces outward.

2. An insulating holder for beverage containers comprising:

a cylindrical main panel, the main panel being formed from a rectangular sheet of flexible material, wherein the main panel has a height, a top edge and a bottom edge, and wherein the top edge and the bottom edge have a main panel length;

a handle attached to the main panel, the handle being formed from a second rectangular sheet of flexible material and having a top short edge and a bottom short edge, wherein a handle length is greater than the height of the main panel;

a first binding with a first binding length equal to the length of the top edge of the main panel; and a second binding with a second binding length equal to the length of the bottom edge of the main panel, wherein the first binding is sewn to the main panel along the top edge of the main panel, wherein the second binding is sewn to the main panel along the bottom edge of the main panel, wherein the top short edge of the handle is attached to and aligned with a portion of the top edge of the main panel, and wherein the bottom edge of the handle is attached to and aligned with a portion of the bottom edge of the main panel.

* * * * *